United States Patent [19]

Thangavelu

[11] Patent Number: 5,024,295

[45] Date of Patent: Jun. 18, 1991

[54] RELATIVE SYSTEM RESPONSE ELEVATOR DISPATCHER SYSTEM USING ARTIFICIAL INTELLIGENCE TO VARY BONUSES AND PENALTIES

[75] Inventor: Kandasamy Thangavelu, Avon, Conn.

[73] Assignee: Otis Elevator Company, Farmington, Conn.

[21] Appl. No.: 318,307

[22] Filed: Mar. 3, 1989

Related U.S. Application Data

[63] Continuation-in-part of Ser. No. 209,744, Jun. 21, 1988, Pat. No. 4,838,384.

[51] Int. Cl.[5] ..... B66B 1/18

[52] U.S. Cl. ..... 187/125; 187/127

[58] Field of Search ..... 187/124, 125, 127

[56] References Cited

U.S. PATENT DOCUMENTS

| | | | |
|---|---|---|---|
| 3,857,465 | 12/1974 | Iwasaka et al. | 187/128 |
| 4,023,135 | 5/1977 | Hanmura et al. | 340/1 R |
| 4,030,572 | 6/1977 | Kaneko et al. | 187/125 |
| 4,112,419 | 9/1978 | Kinoshita et al. | 340/1 R |
| 4,244,450 | 1/1981 | Umeda et al. | 187/124 |
| 4,303,851 | 12/1981 | Mottier | 235/92 PK |
| 4,305,479 | 12/1981 | Bittar et al. | 187/125 |
| 4,323,142 | 4/1982 | Bittar | 187/127 |
| 4,330,836 | 5/1982 | Donofrio et al. | 364/567 |
| 4,363,381 | 12/1982 | Bittar | 187/127 |
| 4,411,338 | 10/1983 | Kuzunuki et al. | 187/124 |
| 4,458,787 | 7/1984 | Uetani | 187/127 |
| 4,473,134 | 9/1984 | Uetani | 187/124 |
| 4,499,975 | 2/1985 | Tsuji | 187/125 |
| 4,503,941 | 3/1985 | Takabe | 187/128 |
| 4,523,665 | 6/1985 | Tsuji | 187/127 |
| 4,524,418 | 6/1985 | Araya et al. | 364/436 |
| 4,542,463 | 9/1985 | Uetani | 364/424 |
| 4,553,639 | 11/1985 | Uetani | 187/131 |
| 4,562,530 | 12/1985 | Umeda et al. | 364/148 |
| 4,567,558 | 1/1986 | Umeda et al. | 364/148 |
| 4,612,624 | 9/1986 | Tsuji | 364/581 |
| 4,663,723 | 5/1987 | Umeda | 364/492 |
| 4,672,531 | 6/1987 | Uetani | 364/138 |
| 4,677,577 | 6/1987 | Takabe et al. | 364/554 |
| 4,691,808 | 9/1987 | Nowak et al. | 187/125 |
| 4,802,082 | 1/1989 | Uetani | 187/127 X |
| 4,815,568 | 3/1989 | Bittar | 187/127 |
| 5,536,842 | 8/1989 | Yoneda et al. | 364/424 |

OTHER PUBLICATIONS

"Forecasting Methods and Applications" by Spyros Makridakis & Steven C. Wheelwright (John Wiley & Sons, Inc., 1978), Sections 3.3,3.6,3.5.

*Primary Examiner*—A. D. Pellinen
*Assistant Examiner*—W. E. Duncanson, Jr.

[57] ABSTRACT

An elevator system employing a micro-processor-based group controller (FIG. 2) communicating with the cars (3, 4) to assign cars to hall calls based on a Relative System Response (RSR) approach. However, rather than using unvarying bonuses and penalties, the assigned bonuses and penalties are varied using "artificial intellience" techniques based on combined historic and real time traffic predictions to predict the number of people behind a hall call, and, calculating and using the average boarding and de-boarding rates at "en route" stops, and the expected car load at the hall call floor. Prediction of the number of people waiting behind hall calls for a few minute intervals are made using traffic levels measured during the past few time intervals on that day as real time predictors, using a linear exponential smoothing model, and traffic levels measured during similar time intervals on previous similar days as historic traffic predictors, using a single exponential smoothing model. The remaining capacity in the car at the hall call floor is matched to the waiting queue using a hall call mismatch penalty. The car stop and hall stop penalties are varied based on the number of people behind the hall call and the variable dwell times at "en route" stops. The stopping of a heavily loaded car to pick up a few people is penalized using a car load penalty. These enhancements to RSR result in equitable distribution of car stops and car loads, thus improving handling capacity and reducing waiting and service times.

20 Claims, 8 Drawing Sheets

RELATIVE SYSTEM RESPONSE ELEVATOR DISPATCHER SYSTEM USING ARTIFICIAL INTELLIGENCE TO VARY BONUSES AND PENALTIES

REFERENCE TO RELATED APPLICATIONS

This application is a continuation-in-part of Ser. No. 07/209,744 entitled "Queue Based Elevator Dispatching System Using Peak Period Traffic Prediction" filed June 21, 1988, now U.S. Pat. No. 4,838,384 the disclosure of which is incorporated herein by reference.

This application also relates to some of the same subject matter as the co-pending applications listed below and owned by the assignee hereof, the disclosures of which are also incorporated herein by reference:

Ser. No. 07/192,436 of Joseph Bittar entitled "Weighted Relative System Response Elevator Car Assignment System With Variable Bonuses And Penalties" filed May 11, 1988, now U.S. Pat. No. 4,815,568, and Ser. No. 07/38,295 of the inventor hereof entitled "'Artificial Intelligence' Based Crowd Sensing System For Elevator Car Assignment" filed on even date herewith.

TECHNICAL FIELD

The present invention relates to elevator systems and to dispatching cars in an elevator system. More particularly the invention relates to the assignment of hall calls to a selected one of a group of elevators serving floor landings of a building in common, based on weighted Relative System Response (RSR) considerations.

These RSR considerations include factors which take into account system operating characteristics in accordance with a scheme of operation, which includes a plurality of desirable factors, the assignments being made based upon a relative balance among the factors, in essence assigning "bonuses" and "penalties" to the cars in determining which cars are to be assigned to which hall calls through a computer algorithm.

Even more particularly, the present invention relates to dispatching cars based on a dispatcher algorithm with variable bonuses and penalties, using "artificial intelligence" ("AI") techniques based on real time and historic traffic predictions to predict the number of people behind a hall call, the expected boarding and de-boarding rates at "en route" stop(s), and the expected car load at the hall call floor, and then varying the RSR bonuses and penalties based on this information to distribute car loads and stops more equitably.

BACKGROUND ART

General Information

In an elevator system, using a Relative System Response (RSR) measure to assign elevator cars to hall calls, the car to hall call travel time is expressed in terms of various time related penalties. These penalties are added together and summed with various penalties that penalize undesirable operating characteristics. Bonuses are given for desirable operating situations and these are subtracted from the sum of penalties resulting in the Relative System Response or RSR value. These values are calculated for each car for a given hall call and the car with the minimum RSR value is assigned to answer the hall call. The penalties and bonuses selected for various time delays and operating characteristics are either fixed or they are varied based on, for example, the past five (5) minute average hall call waiting time and the current hall call registration time.

The above schemes treat all hall calls equally without regard to the number of people waiting behind the hall call. They also treat all cars equally without regard to the current car load, unless the car is fully loaded. It considers only the current car load, but not the expected car load when the car reaches the hall call floor. As a result the car assigned in one cycle is often deassigned later, because the car later becomes full, and another car is assigned. Often the assigned car does not have adequate capacity So, when it stops and picks up people, some people are left out, and they then need to re-register the hall call, resulting in increased waiting time and user irritation. An extra car has to be sent there, thus increasing the number of car stops and decreasing the system's handling capacity. When a large number of people are waiting, although more than one car will be needed to serve the waiting people, the prior RSR systems still assign only one car, resulting in delayed service and large waiting time for a large number of people.

When the cars stop at "en route" floors, the passenger transfer time depends on the number of people boarding and de-boarding the car. By using a fixed car stop penalty, the delays due to "en route" stops are only partially penalized. Large "en route" stops have a high probability of the cars being delayed, cars becoming full before reaching the hall call floor and cars making additional car call stops for car calls generated at "en route" hall call floors. These are detrimental to system performance, as they often cause hall call reassignment, but are not properly penalized.

Often heavily loaded cars are stopped for picking up one or two people. This increases the service time to a large number of people. The prior RSR systems do not distribute car load and car stops as effectively as possible, due to the lack of knowledge of the number of people waiting behind the hall calls and the number of people expected to be de-boarding and boarding the car at "en route" stops, and hence the expected car load when the car reaches the hall call floor.

For further general background information on RSR elevator car assignment systems, either with fixed or variable bonuses and penalties, reference is had to assignee's U.S. Pat. No. 4,363,381 issued to Joseph Bittar on Dec. 14, 1982, and the above-referenced Ser. No. 07/192,436, respectively. These approaches are further discussed below in the sub-section entitled "RSR Assignments of Prior Approaches."

Prediction Approaches of Invention

In contrast to the noted prior approaches the current invention uses an "artificial intelligence" methodology to, preferably, collect traffic data and predict traffic levels at all floors in a building at all times of the working day based on historic and real time traffic predictions. It computes passenger de-boarding rates at car call stops and boarding rates at hall call stops. It uses these rates and the current car load to predict the car load and spare capacity when the car would reach a particular or specific hall call stop. These predictions and other factors are then used to appropriately vary the RSR penalties and bonuses for assignment of each hall call to one or more cars.

Part of the strategy of the present invention in its accurate prediction or forecasting of traffic demands at all times of the working day is to use single exponential smoothing and/or linear exponential smoothing. It is noted that some of the general prediction or forecasting techniques of the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

DISCLOSURE OF INVENTION

The present invention and its preferred algorithms originated from the need to distribute the car load and car stops equitably, so as to minimize the service time and the waiting time of passengers and improve handling capacity. This distribution is achieved by, for example, "knowing" through traffic prediction the number of people waiting behind the hall call, and the number of people expected to be boarding and de-boarding at various car stops, and the currently measured car load.

Using this information, the car load when the car reaches the hall call floor is calculated, and the resulting spare capacity estimated. This spare capacity is matched with the predicted number of people waiting at the hall call floor. Any mismatch between predicted spare capacity and the number of people waiting at the hall call then is used to allow or disallow the car to answer the hall call, using a hall call mismatch penalty.

The dwell times at various floors are computed using the predicted car load and the passenger de-boarding and boarding rates. The car stop penalty and the hall stop penalty are varied as functions of the dwell time and the number of people waiting behind the hall call. Thus, the car stops for hall call and car call are penalized based on the expected passenger transfer time and the expected number of people waiting behind the hall call to be assigned, so that, when a large number of people are waiting, a car with fewer "en route" stops is selected.

The stopping of a heavily loaded car to pick up a few people increases service time for a large number of people. Therefore, this is penalized by, for example, using a car load penalty which varies proportionally to the number of people in the car, but at a lower rate as a function of the number of people waiting behind the hall call.

These penalties are included in the RSR value computations. Thus, the resulting RSR value is affected by the car load at the hall call floor, the number of people waiting at the hall call floor and the number of people boarding and de-boarding the car at "en route" stops. All of these values are obtained by using "artificial intelligence" based traffic prediction methodology.

The resulting RSR algorithm, being enhanced with the present invention, is thus more responsive to traffic conditions and distributes car loads and stops more efficiently, resulting in lower waiting time and service time and higher handling capacity.

Past system information is recorded in "historic" and "real time" data bases, and the stored information used for further predictions.

Thus, the present invention dispatches elevator cars to be dispatched based on a dispatcher algorithm with variable bonuses and penalties using "artificial intelligence" ("AI") techniques based on historic and real time traffic predictions to predict the number of people behind a hall call, the expected boarding and de-boarding rates at "en route" stops, and the expected car load at the hall call floor, and varying the RSR bonuses and penalties based on this information to distribute car loads and stops more equitably.

Exemplary approaches and other related RSR techniques achieving the foregoing are described and detailed further in the "best mode" section below.

The invention may be practiced in a wide variety of elevator systems, utilizing known technology, in the light of the teachings of the invention, which are discussed in detail hereafter.

Other features and advantages will be apparent from the specification and claims and from the accompanying drawings, which illustrate an exemplary embodiment of the invention.

BRIEF DESCRIPTION OF DRAWINGS

FIG. 1 is a simplified, schematic block diagram, partially broken away, of an exemplary elevator system in which the present invention may be incorporated; while

BEST MODE FOR CARRYING OUT THE INVENTION

Exemplary Elevator Application

For the purposes of detailing an exemplary application of the present invention, the disclosures of the above referenced Bittar U.S. Pat. No. 4,363,381, as well as of the commonly owned U.S. Pat. No. 4,330,836 entitled "Elevator Cab Load Measuring System" of Donofio & Games issued May 18, 1982, are incorporated herein by reference.

The preferred application for the present invention is in an elevator control system employing a microprocessor-based group controller dispatcher using signal processing means, which communicates with the cars of the elevator system to determine the conditions of the cars and responds to hall calls registered at a plurality of landings in the building serviced by the cars under the control of the group controller, to provide assignments of the hall calls to the cars based on the weighted summation for each car, with respect to each call, of a plurality of system response factors indicative of various conditions of the car irrespective of the call to be assigned, as well as indicative of other conditions of the car relative to the call to be assigned, assigning "bonuses" and "penalties" to them in the weighted summation. An exemplary elevator system and an exemplary car controller (in block diagram form) are illustrated in FIGS. 1 & 2, respectively, of the '381 patent and described in detail therein.

Figure 1:
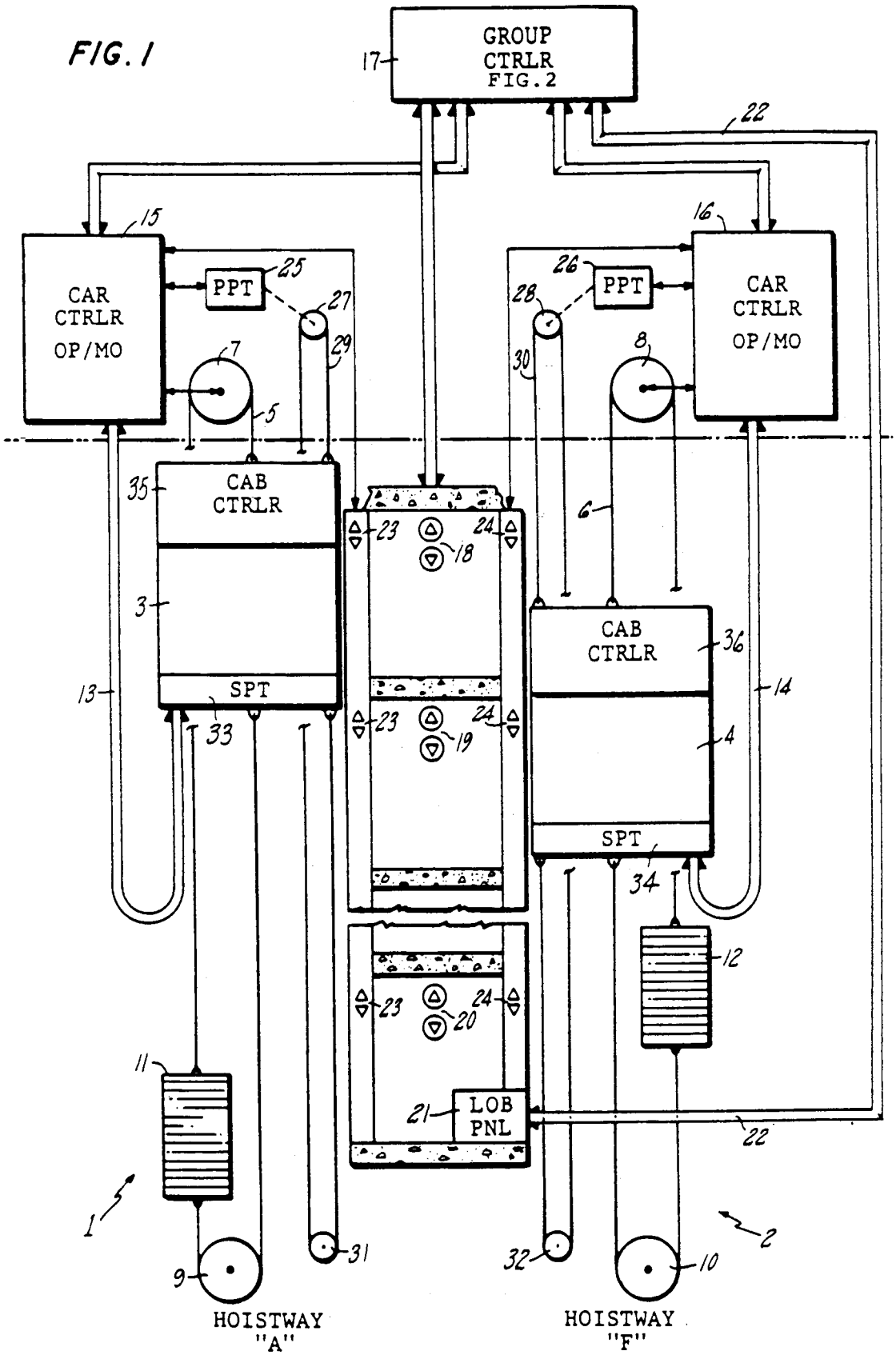
Figure 2:
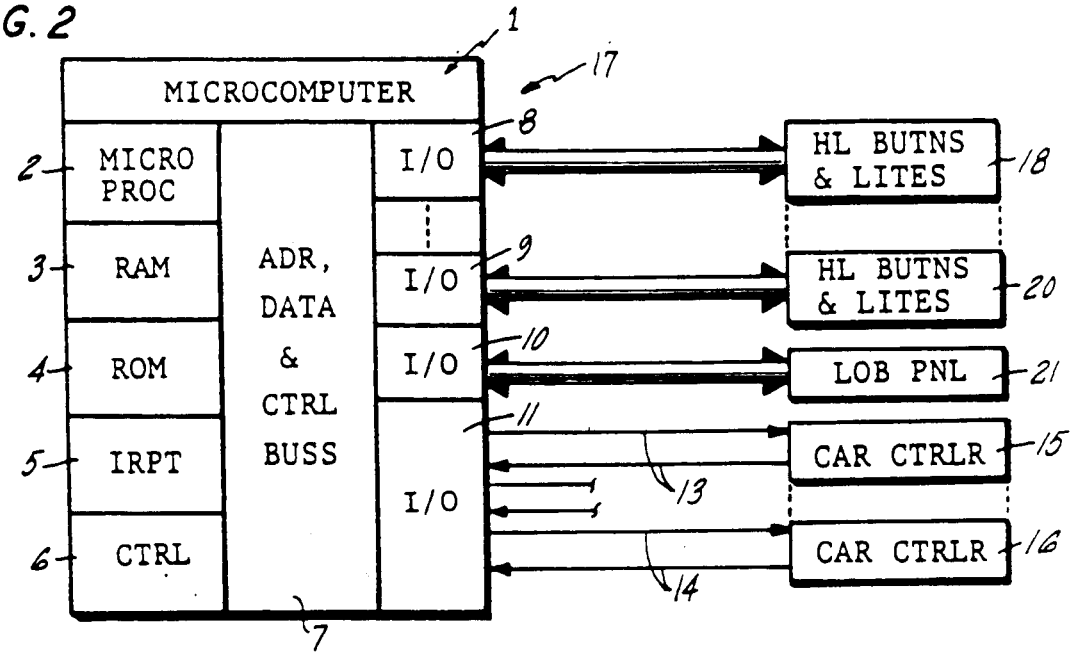
FIG. 2 is a simplified, schematic block diagram of an exemplary car controller, which may be employed in the system of 1, and in which the invention may be implemented.

It is noted that FIGS. 1 & 2 hereof are substantively identical to the same figures of the '381 patent and the above-referenced, co-pending application Ser. No. 07/192,436. For the sake of brevity the elements of FIGS. 1 & 2 are merely outlined or generally described below, as was done in the co-pending application, while any further, desired operational detail can be obtained from the '381 patent, as well as other of assignee's prior patents.

In FIG. 1, a plurality of exemplary hoistways, HOISTWAY "A" 1 and HOISTWAY "F" 2 are illustrated, the remainder not being shown for simplicity purposes. In each hoistway, an elevator car or cab 3, 4 is guided for vertical movement on rails (not shown).

Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 16, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18–20 on the floors of the buildings and allocates those calls to the various cars for response, and distributes cars among the floors of the building, in accordance with any one of several various modes of group operation. Modes of group operation may be controlled in part, for example, by a lobby panel ("LOB PNL") 21, which is normally connected by suitable building wiring 22 to the group controller in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The position of the car within the hoistway may be derived from a primary position transducer ("PPT") 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the "PPT" 25, 26, may employ a secondary position transducer ("SPT") 33, 34. Or, if desired, the elevator system in which the present invention is practiced may employ inner door zone and outer door zone hoistway switches of the type known in the art.

The foregoing is a description of an elevator system in general, and, as far as the description goes thus far, is equally descriptive of elevator systems known to the prior art, as well as an exemplary elevator system which could incorporate the teachings of the present invention.

All of the functions of the cab itself may be directed, or communicated with, by means of a cab controller 35, 36 in accordance with the present invention, and may provide serial, time-multiplexed communications with the car controller, as well as direct, hard-wired communications with the car controller by means of the traveling cables 13 & 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller 35, 36 interfaces with load weighing transducers to provide weight information used in controlling the motion, operation, and door functions of the car. The load weighing data used in the invention may use the system disclosed in the above cited '836 patent.

An additional function of the cab controller 35, 36 is to control the opening and closing of the door, in accordance with demands therefore, under conditions which are determined to be safe.

The makeup of microcomputer systems, such as may be used in the implementation of the car controllers 15, 16, a group controller 17, and the cab controllers 35, 36, can be selected from readily available components or families thereof, in accordance with known technology as described in various commercial and technical publications. The software structures for implementing the present invention, and peripheral features which may be disclosed herein, may be organized in a wide variety of fashions.

RSR Assignments of Prior Approaches

As noted above, an earlier car assignment system, which established the RSR approach and was described in the commonly owned '381 patent, included the provision of an elevator control system in which hall calls were assigned to cars based upon Relative System Response (RSR) factors and provided the capability of assigning calls on a relative basis, rather than on an absolute basis, and, in doing so, used specific, pre-set values for assigning the RSR "bonuses" and "penalties".

However, because the bonuses and penalties were fixed and preselected, waiting times sometimes became large, depending on the circumstances of the system. Thus, although the '381 invention was a substantial advance in the art, further substantial improvement was possible and was achieved in the invention of the above-referenced, copending application Ser. No. 07/192,436.

In that invention the bonuses and penalties were varied, rather than preselected and fixed as in the '381 invention, as functions, for example, of recently past average hall call waiting time and current hall call registration time, which could be used to measure the relatively current intensity of the traffic in the building. An exemplary average time period which could be used was five (5) minutes, and a time period of that order was preferred.

During system operation, the average hall call waiting time for the selected past time period was estimated using, for example, the clock time at hall call registration and the hall call answering time for each hall call and the total number of hall calls answered during the selected time period. The hall call registration time was computed, from the time when the hall call was registered until the time when the hall call was to be assigned. According to that invention, the penalties and bonuses were selected, so as to give preference to the hall calls that remain registered for a long time, relative to the past selected period's average waiting time of the hall calls.

When the hall call registration time was large compared to the past selected time period's average wait time, then the call would have high priority and thus should not wait for, for example, cars having a coincident car call stop or a contiguous stop and should not wait for cars having less than the allowable number of calls assigned. MG set on and not parked. Thus, for these situations, the bonuses and penalties would be varied by decreasing them.

When the hall call registration time was small compared to the selected time period's average waiting time, the reverse situation would be true, and the bonuses and penalties would be varied for them by increasing them.

The functional relationship used to select the bonuses and penalties related, for example, the ratio of hall call registration time to the average past selected time period's hall call waiting time to the increases and decreases in the values of the bonuses and penalties.

As a variant to the foregoing, the bonuses and penalties could be decreased or increased based on the difference between the current hall call registration time and the past selected time period's average hall call waiting time as a measure of current traffic intensity.

Exemplary "AI" Based Variable Bonuses/Penalties

The "AI" principles used in the invention and the application of the invention in a detailed exemplary embodiment will be discussed first, and then the exemplary embodiment will be further discussed in association with the drawings.

Between, for example, 6:00 AM and midnight, that is for the whole active work day, at each floor in the building in each direction, the following traffic data is collected for short periods of time, for example, each one (1) minute interval, in terms of the:

number of hall call stops made, number of passengers boarding the cars using car load measurements at the floors, number of car call stops made, and number of passengers de-boarding the cars, again using car load measurements at the floors.

At the end of each interval, the data collected during, for example, the past three intervals at various floors in terms of passenger counts and car stop counts are analyzed. If the data shows that car stops were made at any floor in any direction in, for example, two (2) out of the three (3) past minutes and on the average more than, for example, two (2) passengers boarded or two (2) passengers de-boarded each car at that floor and direction, during at least two (2) intervals, the real time prediction for that floor and direction is initiated.

The traffic for the next few two (2) or three (3) intervals for that floor, direction and traffic type (boarding or de-boarding) is then predicted, using preferably a linear exponential smoothing model. Both passenger counts and car stop counts (hall call stops or car call stops) are thus predicted. The traffic preferably is also predicted for a few look-ahead intervals beyond the next interval.

Large traffic volume may be caused by normal traffic patterns occurring on each working day of the week or due to special events occurring on the specific day.

The real time prediction is terminated, when the total number of cars stopping at the floor in that direction and for that traffic type is less than, for example, two (2) for four (4) consecutive intervals and the average number of passengers boarding the cars or de-boarding the cars during each of those intervals is less than, for example, two (2.0).

Whenever significant traffic levels have been observed at a floor in a direction and real time traffic predictions made, the real time collected data for various intervals is saved in the historic data base, when the real time prediction is terminated. The floor where the traffic was observed, the traffic direction and type of traffic in terms of boarding or de-boarding counts and hall call stops or car call stops are recorded in the historic data base. The starting and ending times of the traffic and the day of the week are also recorded in the historic data base.

Once a day, at midnight, the data saved during the day in the historic data base is compared against the data from the previous days. If the same traffic cycle repeats each working day within, for example, a three (3) minute tolerance of starting and ending times and, for example, a fifteen (15%) percent tolerance in traffic volume variation during the first four and last four short intervals, the current day's data is saved in the normal traffic patterns file.

If the data does not repeat on each working day, but if the pattern repeats on each same day of the week within, for example, a three (3) minute tolerance of starting and ending times and, for example, a fifteen (15%) percent tolerance in traffic volume variation during the first four and last four intervals, the current day's data is saved in the normal weekly patterns file.

After the data collected during the day are thus analyzed and saved in the normal patterns file and normal weekly patterns file, all the data in those files for various floors, directions, traffic types are used to predict traffic for the next day. For each floor, direction and traffic type, the various occurrences of historic patterns are identified one by one. For each such occurrence, the traffic for the next day is predicted using the data at the previous occurrence and the predicted data at the last occurrence and using the exponential smoothing model. All normal traffic patterns and normal weekly traffic patterns expected to be occurring on the next day are thus predicted and saved in the current days historic prediction data base.

At the end of each data collection interval, the floors and directions where significant traffic has been observed, are identified. After the real time traffic for the significant traffic type has been predicted, the current day's historic prediction data base is checked to identify if historic traffic prediction has been made at this floor and direction for the same traffic type for the next interval.

If so, then the two predicted values are combined to obtain optimal predictions. These predictions will give equal weight to historic and real time predictions and hence will use a weighing factor of one-half (0.5) for both. If however, once the traffic cycle has started, the real time predictions differ from the historic prediction by more than, for example, twenty (20%) percent in, for example, four (4) out of six (6) one minute intervals, the real time prediction will be given a weight of, for example, three-quarters (0.75) and the historic prediction a weight of one-quarter (0.25), to arrive at a combined optimal prediction.

The real time predictions shall be made for passenger boarding or de-boarding counts and car hall call or car call stop counts for up to three (3) or four (4) minutes from the end of the current interval. The historic prediction data for up to three or four minutes will be obtained from the previously generated data base. So the combined predictions for passenger counts and car counts can also be made for up to three to four minutes from the end of the current interval.

If no historic predictions have been made at that floor for the same direction and traffic type for the next few intervals, the real time predicted passenger counts and car counts for the next three (3) or four (4) minutes are used as the optimal predictions.

Using this predicted data, the passenger boarding rate and de-boarding rate at the floor where significant traffic occurs are then calculated. The boarding rate is calculated as the ratio of total number of passengers boarding the cars at that floor in that direction during that interval to the number of hall call stops made at that floor in that direction during the same interval. The deboarding rate is calculated as the ratio of number of passengers de-boarding the cars at that floor, in that direction in that interval to the number of car call stops made at that floor in that direction in the same interval.

The boarding rate and de-boarding rate for the next three (3) to four (4) minutes for the floors and directions where significant traffic is observed are thus calculated once a minute. If the traffic at a floor and a direction is not significant, i.e. less than, for example, two (2) persons board the car or de-board the car on the average, the boarding or de-boarding rates are not calculated.

Then, when a hall call is received, for each car the expected car load at the hall call floor is computed. The car load, when the car reaches the hall call floor, equals the current car load plus the sum of the passengers predicted to be boarding at "en route" hall call stops already assigned to the car, minus the sum of the passengers predicted to be de-boarding the cars at the already registered car call stops.

In computing this car load, if the traffic at any of the "en route" hall call stops or car call stops is not significant and hence has not been predicted, it is assumed that only one (1) person will board the car at the hall call stop and only one (1) person will de-board the car at the car call stop.

The computed car load is used to compute spare capacity in the car in terms of passengers. The expected boarding rate at the hall call floor is compared against the spare capacity. A penalty, termed the "hall call mismatch penalty" ("HCM"), is used to allow or disallow the car to answer the hall call, as follows.

If the floor of hall call origination does not have significant traffic, then, since only one (1) person is assumed to be boarding the car at the hall call floor, the car is eligible for assignment, if it is not fully loaded, i.e. the load does not exceed, for example, eighty (80%) percent of the capacity. So, if the computed car load, when the car reaches the current hall call floor, is less than eighty (80%) percent, the "HCM" is set to zero. If the computed car load exceeds eighty (80%) percent, the "HCM" is set to, for example, "200". This approach is different from the approach of the '381 patent, which uses current car load to allow or disallow the car for assignment and does not consider the boarding and de-boarding rates at "en route" hall call and car call stops. This approach thus minimizes hall call reassignment, due to a car becoming fully loaded at en route stops.

The RSR dispatcher of the '381 patent also does not use the estimated number of people waiting at the hall call floor to select the car for assignment.

In the present invention, if the floor of hall call origination has significant traffic, then after the car load at the hall call floor is computed, the spare capacity in the car is computed in terms of the number of passengers. If the predicted boarding rate at the hall call floor is less than or equal to (≦) "the single car limiting queue size" and, if the spare capacity in the car is equal to or greater (≧) than the average boarding rate at the hall call floor, then the car is eligible for assignment, the "HCM" is set to zero. If the average boarding rate at the hall call floor is less than (<) the single car limiting queue size, but the spare capacity in the car is less than the average boarding rate at the hall call floor, then the car is not eligible for assignment for the hall call floor Therefore, the "HCM" is set to, for example, "200".

Thus, the stopping of multiple cars to pick up a small number of people is avoided. This improves car productivity by minimizing car stops.

If the average boarding rate at the hall call floor exceeds the single car limiting queue size, then, if the car's spare capacity is less than the "multi-car minimum pick-up limit", say, for example, two (2) persons, the car is not eligible for assignment and its "HCM" is set to "200".

If, when the average boarding rate at the hall call floor exceeds the single car limiting queue size, the car's spare capacity equals or exceeds (≧) the multi-car minimum pick-up limit, the "HCM" penalty is set to zero.

Then, if the car's spare capacity is less than (<) the average boarding rate at the hall call floor, the car will generate a "second car requested ('SCR')" signal. If the car with the lowest RSR does not generate a "SCR" signal, that car alone will answer the hall call. If the car with the lowest RSR generates a "SCR" signal, the car with the next lowest RSR also will answer the hall call.

The single car limiting queue size and the multi-car minimum pick-up limit are functions of traffic density at that time. The values are learned by the system and changed, for example, once every five (5) minutes.

When the first car answers the hall call, if it is not fully loaded when it closes the doors at the hall call floor, it produces a cancel "SCR" message, indicating that all of the waiting passengers have been picked up. The other car answering that hall call due to the "SCR" signal will then de-assign itself for that hall call.

The RSR dispatcher of the '381 patent uses a fixed car stop penalty and hall stop penalty. Typical values for the car stop penalty ("CSP") is ten (10) and that for the hall stop penalty ("HSP") is eleven (11).

When the traffic data is predicted and the car load estimated at the various car stop and hall stop floors, the car's remaining capacity and the expected passenger boarding and de-boarding rates are used to compute the required door dwell time (car stop time) at the floor, using an appropriate mathematical model based on, for example, real world observations.

So for each car call stop and hall call stop, the car stop penalty will be incremented if the required car stop time exceeds, for example, one (1) second and the hall stop time exceeds, for example, three (3.0) seconds. For, for example, each two (2.0) seconds increase in the stop time, the car stop/hall stop penalty is increased by, for example, one (1). Thus, if a car is expected to spend too much time at "en route" stops, because it drops off or picks up a lot of people, this car is adequately penalized.

Additionally, the penalty for a car stop and a hall stop preferably will be varied as a function of the number of people waiting behind the hall call to be assigned.

This is because with each "en route" stop, there is increased probability of car being delayed and getting more loaded due to unpredictable events. Also, when a car makes "en route" stops for hall calls, these in turn can generate additional car call stops in the future, thus further delaying the car. Both the unexpected delays and loads can result in the hall call being reassigned later. Selecting a car with fewer "en route" stops provides better dependability in car arrival at hall call floor. Since high dependability and low probability of reassignment of hall call is desired with longer queues, the car stop penalties increase with queue size. Thus, if there are more people waiting behind the hall call, "en route" stops will be more penalized, while short waiting queues will use low penalties. This will select cars with fewer "en route" stops to serve long queues. This scheme results in less waiting time to a large number of people, resulting in a lower average waiting time for the system.

The table below shows the typical increase of car stop penalties when the dwell time is one (1.0) second for a car stop and three (3.0) seconds for a hall stop.

| NUMBER OF PEOPLE AT HALL CALL | 2 | 3 | 4 | 5 | 6 | 8 | 10 | 12 | 12+ |
|---|---|---|---|---|---|---|---|---|---|
| INCREASE IN "CSP" | 0 | 0 | 1 | 2 | 3 | 4 | 5 | 6 | 8 |
| INCREASE IN "HSP" | 0 | 0 | 1 | 2 | 4 | 5 | 7 | 9 | 12 |

The penalty increases are variable as a function of the traffic intensity. At heavy traffic conditions fewer stops are desired to serve hall calls with long queues; so the penalties increase faster with the queue size. The hall calls with short queues may then be served by cars having more "en route" stops.

When the number of people behind a hall call is predicted, using the "artificial intelligence" techniques of the present invention, and the car load, when the car reaches the hall call floor is computed, a car load penalty ("CLP") is used to penalize the stopping of heavily loaded cars, in the absence of a coincident car call stop at the hall call floor. The penalty is variable and increases proportionally to the number of people in the car. The rate of increase is high, when the number of people waiting behind hall call is low. When the number of people waiting behind the hall call is high, the car load penalty increases with the car load at a lower rate.

If the car has a coincident car call stop, the "CLP" is set to zero ("0").

The variation of the car load penalty ("CLP") with the car load and the number of people waiting behind the hall call can be expressed by a linear correlation model, as follows:

$$CLP = a_{cld}(C_{ld} - C_{ldl}) - b_{phc} * N_{phc}$$

where

"$a_{cld}$" and "$b_{phc}$" are correlation coefficients;

"$C_{ld}$" is the car load when the car reaches the hall call floor;

"$C_{ldl}$" is the set car load limit; and

"$N_{phc}$" is the number of people waiting at the hall call floor.

Exemplary variations for "$a_{cld}$" and "$b_{phc}$" are in the range of three-tenths to three (0.3–3.0) and one-half to one and a half (0.5–1.5), respectively, and for "$C_{ldl}$" four to twelve (4–12).

When the car load is less than "$C_{ldl}$", there is no car load penalty. This limit depends upon the number of people behind the hall call.

As can be seen, the model prefers lightly loaded cars to serve short queues.

The car can take only as many people as there is spare capacity. Thus, the linear equations should not be used if the number of people behind a hall call exceeds the spare capacity. This is taken care of by limiting the car assignment. Thus, if there is not adequate spare capacity, the hall call mismatch penalty ("HCM") precludes a car assignment or, alternatively, more than one car is assigned to answer the hall call.

Thus, the car load penalty increases with the car load ("$C_{ld}$"), but decreases with the number of people behind the hall call ("$N_{phc}$"), and is applied until the sum of "$C_{ld}+N_{phc}$" approaches or reaches the car capacity.

Thus, the "CLP" can be computed using the above equation. The equation is specified in terms of the values of "$a_{cld}$", "$C_{ldl}$" and "$b_{phc}$" and is used for different values of "$N_{phc}$" from, for example, one (1) to twelve (12). When "$N_{phc}$" exceeds twelve (12), the equation for twelve (12) passengers is used.

Figure 3A:
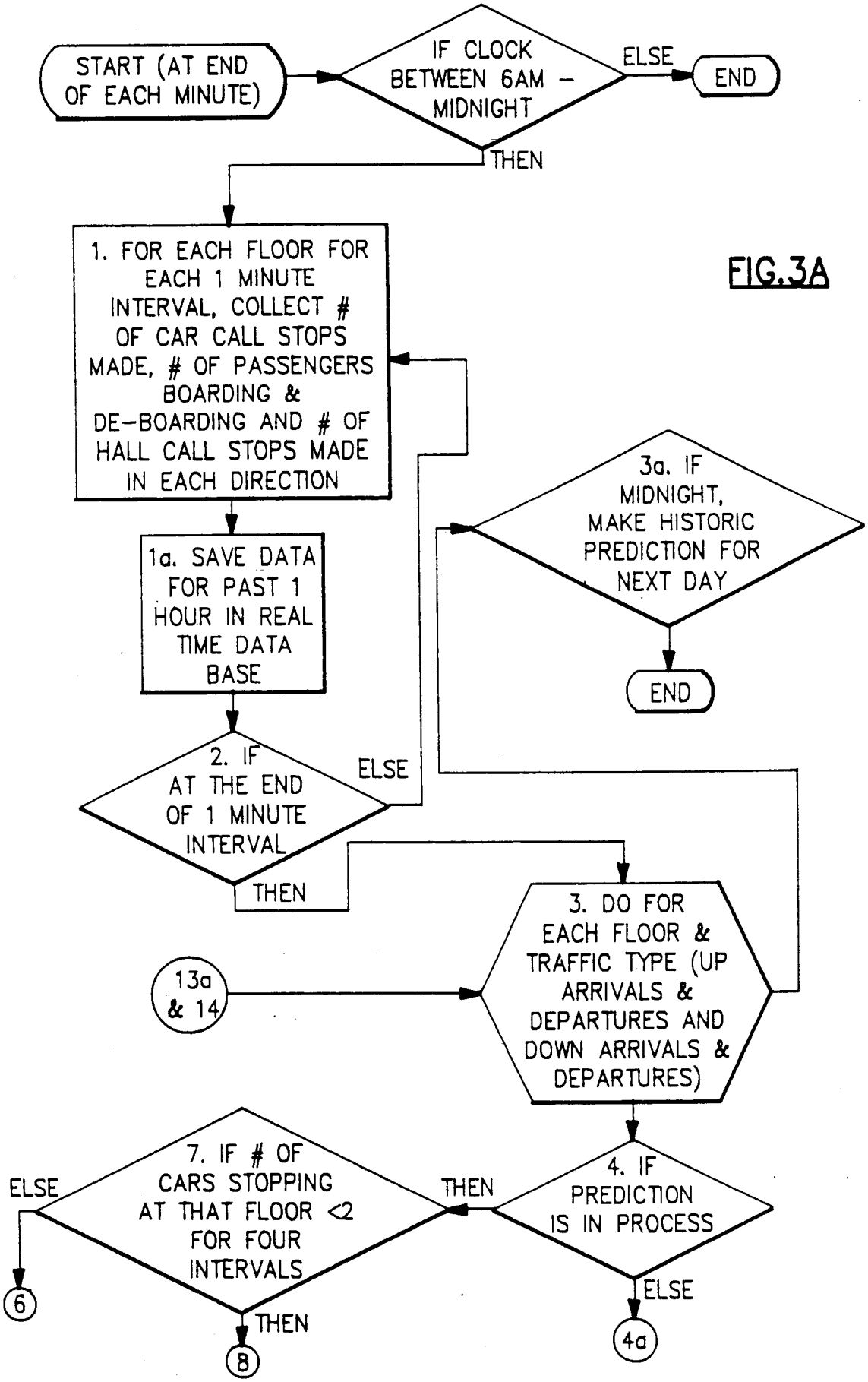
FIGS. 3A & 3B, in combination, provide a simplified, logic flow diagram for the exemplary algorithm for the methodology used to collect and predict traffic and passenger boarding and de-boarding rates at various floors in the preferred embodiment of the present invention.
Figure 3B:
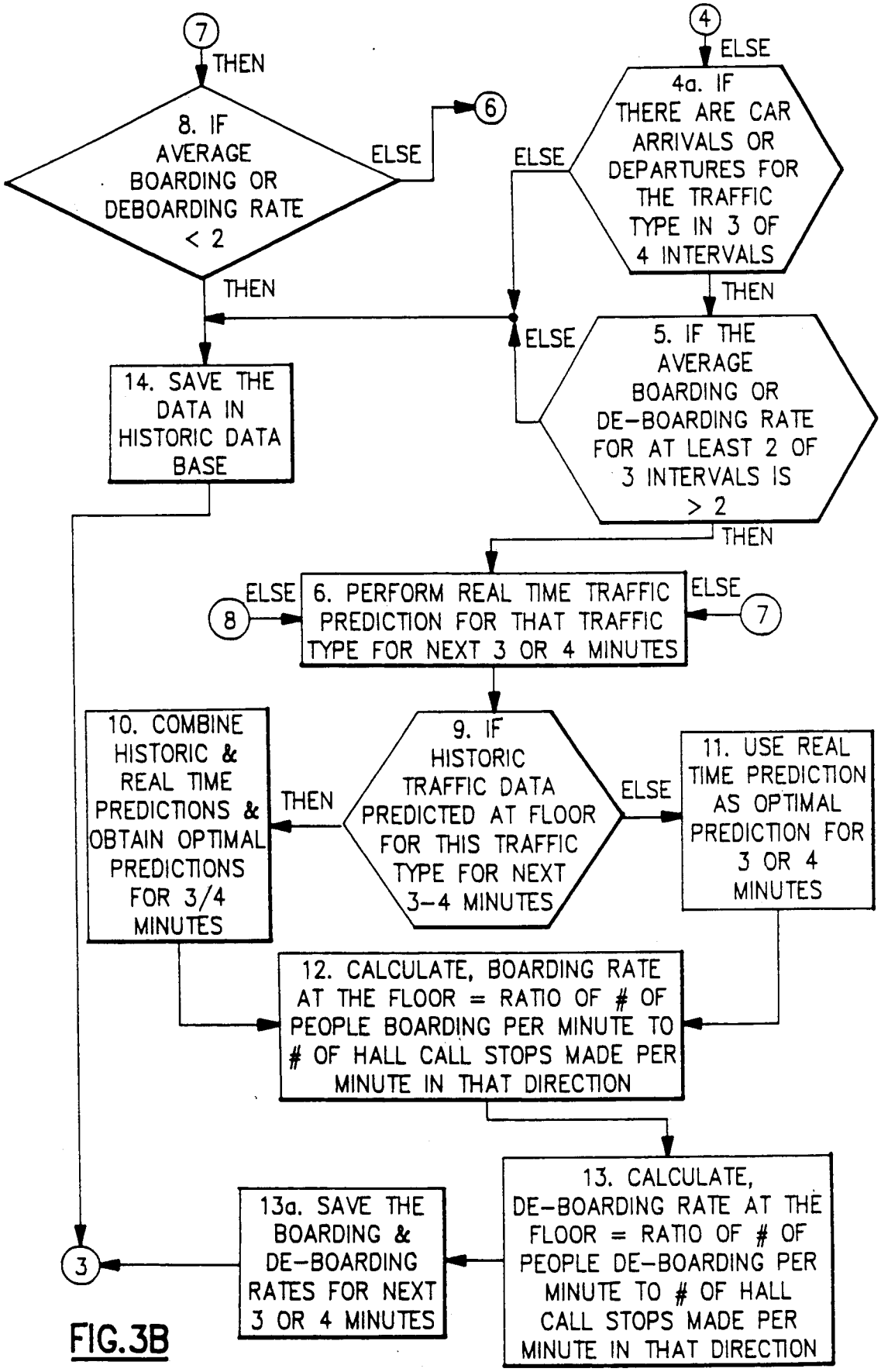
Figure 4A:
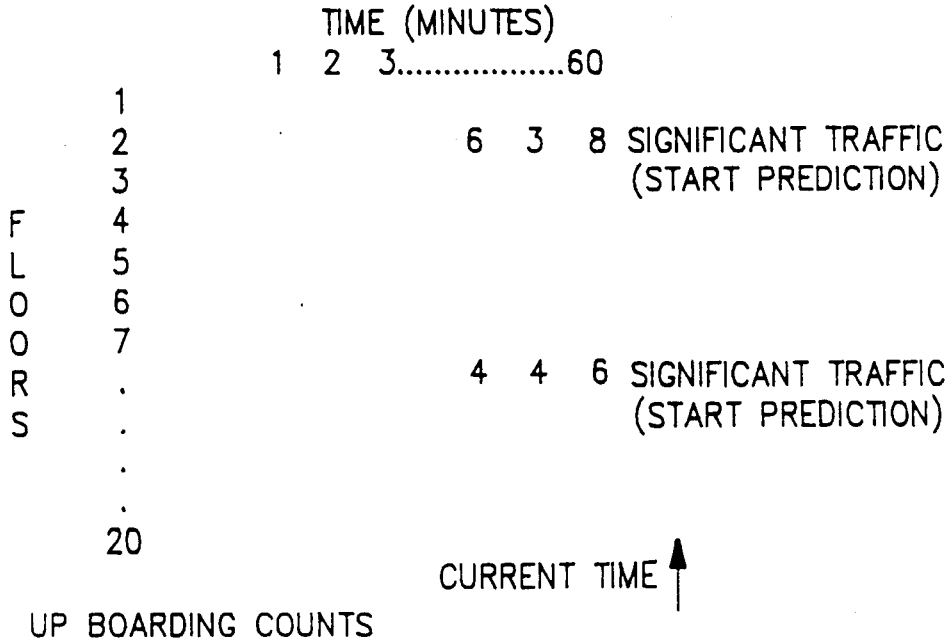
FIGS. 4A and 4B are general illustrations of matrix diagrams illustrating the collection of the real time data in arrays used in the exemplary embodiment of the present invention, showing the collection of "up" boarding counts and "up" hall stop counts at various floors.
Figure 4B:
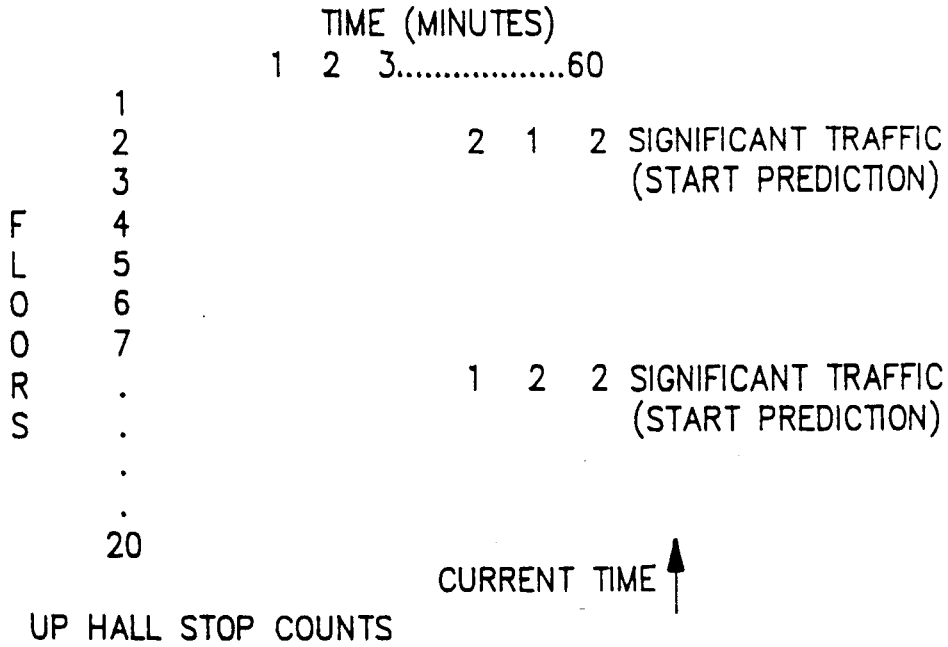

As a particular example of the foregoing, used as the exemplary embodiment of the present invention, the logic block diagram of FIGS. 3A & 3B illustrates the exemplary methodology to collect and predict traffic and compute boarding and de-boarding rates. In steps 3-1 & 3-2 the traffic data is collected for, for example, each one (1) minute interval during an appropriate time frame covering at least all of the active work day, for example, from 6:00 AM until midnight, in terms of the number of passengers boarding the car, the number of hall call stops made, the number of passengers de-boarding the car, and the number of car call stops made at each floor in the "up" and "down" directions. The data collected for, for example, the latest one (1) hour is saved in the data base, as generally shown in FIGS. 4A & 4B and step 3-1.

In steps 3-3 to 3-4*a* at the end of each minute the data is analyzed to identify if car stops were made at any floor in the "up" and "down" direction in, for example, two (2) out of three (3) one minute intervals and, if on the average more than, for example, two (2) passengers de-boarded or boarded each car during those intervals.

If so, significant traffic is considered to be indicated. The traffic for, for example, the next three (3) to four (4) minutes is then predicted in step 3-6 at that floor for that direction using real time data and a linear exponential smoothing model, as generally described in the *Makridakis & Wheelwright* text cited above, particularly Section 3.6, and, as applied to elevator dispatching, in the specification of the parent application cited above. Thus, if the traffic "today" varies significantly from the previous days' traffic, this variation is immediately used in the predictions.

If this traffic pattern repeats each day or each same day of the week at this floor, the data would have been stored in the historic data base and the data for each two (2) or three (3) minute intervals predicted the previous night for this day, using, for example, the method of moving averages or, more preferably, a single exponential smoothing model, which model is likewise generally described in the text of *Makridakis & Wheelwright* cited above, particularly Section 3.3, and, as applied to elevator dispatching, in the specification of the parent application cited above.

If such prediction is available, the historic and real time predictions are combined to obtain optimal predictions in step 3-10. The predictions can combine both real the time predictions and the historic predictions in accordance with the following relationship:

$$X = ax_h + bx_r$$

where "X" is the combined prediction "$x_h$" is the historic prediction and "$x_r$" is the real time prediction for the short time period for the floor, and "a" and "b" are multiplying factors.

Initially, "a" and "b" values of one-half (0.5) are used. If real time predictions differ from historic predictions by more than, for example, twenty (20%) percent for several intervals, the "a" value is reduced and the "b" value is increased, as previously mentioned.

If historic predictions are not available, real time prediction is used for the optimal predictions, as shown in step 3-11.

As can be seen in the figure, other detailed steps or features are included in the algorithm of FIGS. 3A & 3B, but are considered to be self-explanatory in view of the foregoing.

Then, for each floor and direction where significant traffic has been predicted in step 3-12, the average boarding rate is calculated as, for example, the ratio of the predicted number of people boarding the car during the interval to the number of hall call stops made in that interval. The average de-boarding rate is computed in step 3-13 as the ratio of the predicted number of people de-boarding the car during an interval to the number of car call stops made in that interval. These rates are calculated for the next three to four minutes and saved in the data base.

Then, when a hall call is received from a floor, the RSR value for each car is calculated, taking into account the hall call mismatch penalty, the car stop and hall stop penalty and the car load penalty, which are all varied based on the predicted number of people behind the hall call, the predicted car load at the hall call floor and the predicted boarding and de-boarding rate at "en route" stops.

The foregoing is substantively identical to the initial methodology of the concurrently filed application (OT-859).

Figure 5:
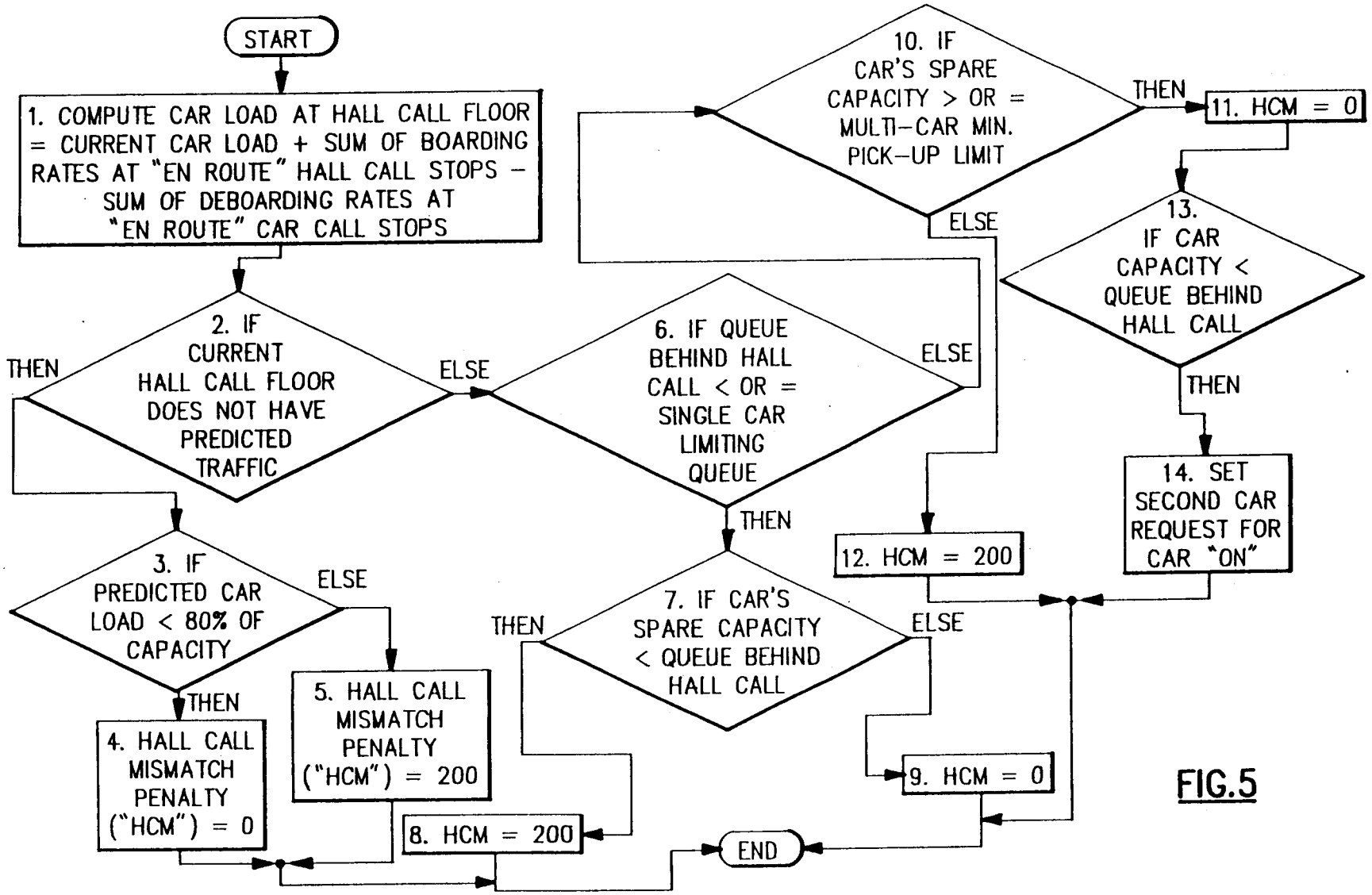
FIG. 5 is a simplified, logic flow diagram for the exemplary algorithm for the methodology used to compute the hall call mismatch penalty in the exemplary embodiment of the present invention.

With reference to the logic block diagram of FIG. 5, which illustrates the exemplary methodology to compute the hall call mismatch penalty, for a given car and hall call in step 5-1 the car load at the hall call floor is computed by adding to the current car load the sum of the boarding rates at "en route" hall stops and then subtracting from the result the sum of the de-boarding rates at the "en route" car stops.

If in step 5-2 the current hall call floor does not have predicted traffic, in step 5-3, if the predicted car load equals or exceeds, for example, eighty percent (80%) of the car's capacity, in step 5-5 the car's hall call mismatch penalty ("HCM") is set to a high value, for example, two hundred ("200") to preclude this car's assignment to the hall call. If not, that is the predicted car load is less than eighty percent of capacity, then, in step 5-3 the hall call mismatch penalty is set to zero.

On the other hand, if the current hall call floor does have predicted traffic in step 5-2 and if the predicted number of people waiting behind the hall call is less than or equal (≦) to the single car limiting queue, for example, five (5), the logic branches to step 5-7. At this step, if the car's spare capacity equals or exceeds (≧) the waiting queue size, the "HCM" is set to zero in step 5-9; otherwise, it is set to "200" in step 5-8. If in step 5-6 the queue size exceeds the single car limiting queue size, then, if the car's spare capacity exceeds the "multi-car minimum pick-up limit," the "HCM" is set to zero in step 5-11; otherwise it is set to "200" in step 5-12 to preclude this car's assignment to this hall call. If necessary, namely if the car capacity is less than the queue behind the hall call, in step 5-14 a second car request ("SCR") is then made when the RSR value is computed.

As can be seen in the figure, other detailed steps or features are included in the algorithm of FIG. 5, but are considered to be self-explanatory.

Figure 6:
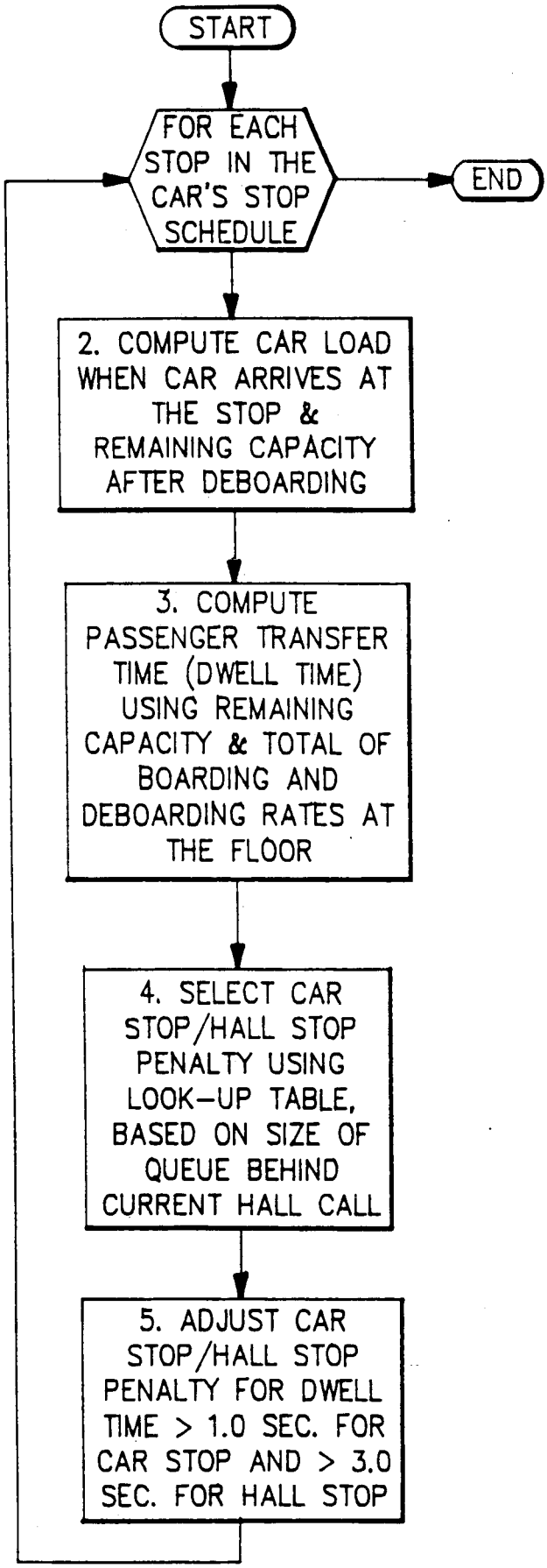
FIG. 6 is a simplified, logic flow diagram for the exemplary algorithm for the methodology used to compute variable car stop and hall stop penalties in the exemplary embodiment of the present invention.

With reference to FIG. 6, which illustrates the exemplary methodology used to compute the variable car stop and hall stop penalties, for each scheduled "en route" stop the current car load and the expected boarding rates at "en route" hall call stops and de-boarding rates at "en route" car call stops are used in steps 6-1 & 6-2 to compute the car load when the car arrives at the stop, the remaining capacity after the passenger de-boarding is complete and the total passenger transfer counts. In step 6-3 the required door dwell time is computed using these parameters and an appropriate mathematical model based on real world observations.

In step 6-4 the penalty for each car stop ("CSP") and hall stop ("HSP") of the car is calculated by adding to the nominal values of these penalty increases based on the number of people waiting behind the hall call ("$N_{phc}$"), using for example the table presented above.

In step 6-5 the penalties so computed are further increased by, for example, "1" for each additional two (2) seconds of dwell time above the minimum one (1) second for car call stop and the minimum three (3) seconds for hall call stop.

Figure 7:
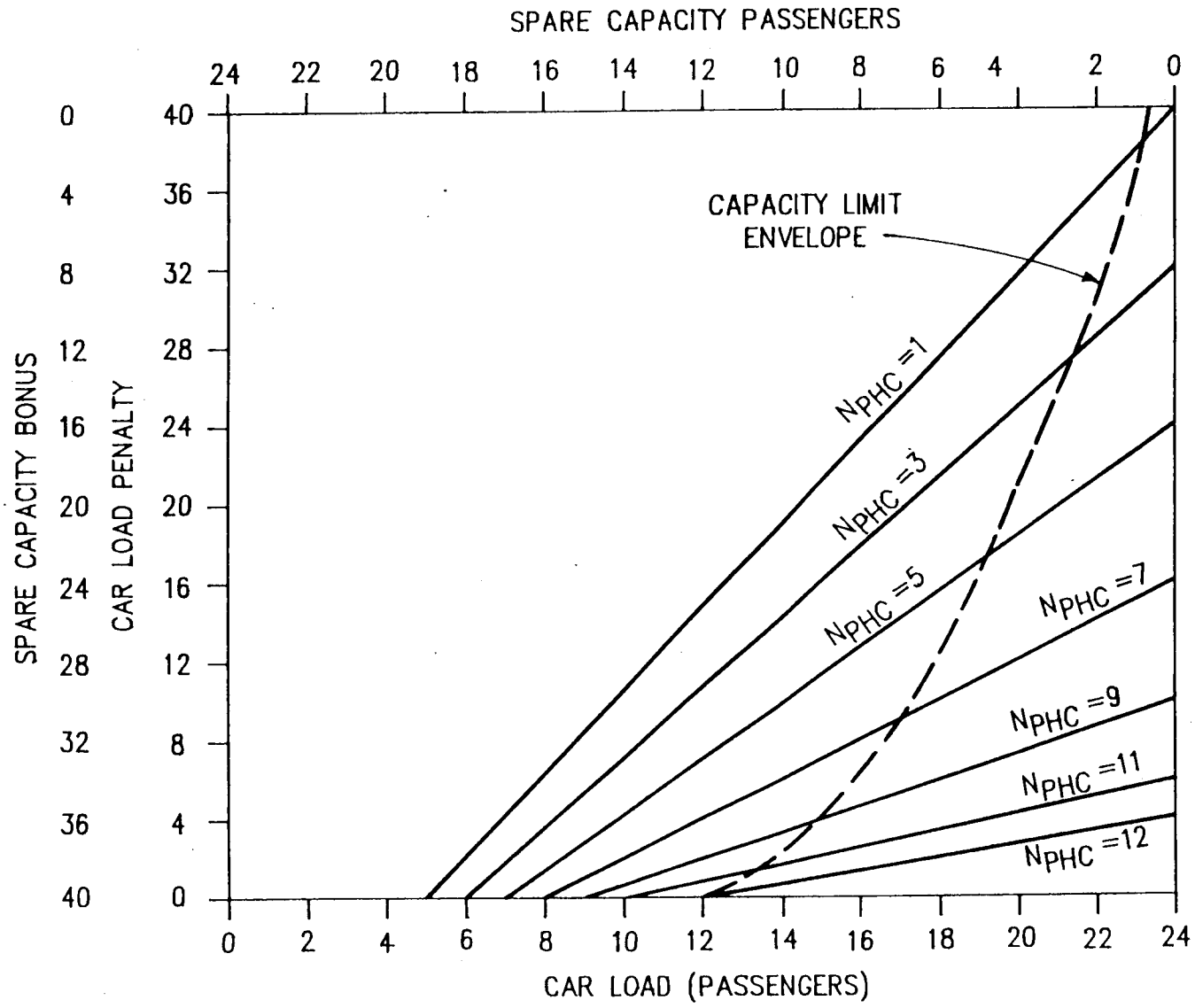
FIG. 7 is a graph illustrating a typical variation of the car load penalty with the car load and the number of people waiting behind the hall call used in the exemplary embodiment of the present invention.

With reference to the graph of FIG. 7, a typical variation of the car load penalty with the car load and the number of people behind the hall call is illustrated for an exemplary four thousand (4,000) pound capacity car, in which "$N_{phc}$", i.e., the number of people waiting at the hall call floor, varies from one (1) to twelve (12) passengers. The graph is based on the equation discussed above.

The penalties so calculated are used in the RSR algorithm with other bonuses and penalties to compute the final, enhanced RSR values. The RSR algorithm with variable bonuses and penalties of the above referenced patent application Ser. No. 07/192,436 may be used with the enhancements of this invention. Thus, the traffic predicted using the "artificial intelligence" methodology of the present invention may be used to vary the bonuses and penalties and compute the resulting RSR values. When cars are assigned to hall calls using this approach, the car stops and the car loads are more equitably distributed, resulting in better service.

Although this invention has been shown and described with respect to detailed, exemplary embodiments thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

I claim:

1. A method of controlling the dispatching of elevator cars based on a system of bonuses and penalties, said penalties including a car load penalty for penalizing the stopping of a relatively loaded elevator car at a predetermined floor registering a hall call, said method comprising the steps of:

determining the load of the car when the car reaches the predetermined floor;

comparing said determined load to a predetermined car load limit; and determining said car load penalty based on said comparison.

2. The method of claim 1, wherein said car load penalty is substantially equal to zero if the car has a coincident car call stop at the predetermined floor.

3. The method of claim 1, said method further comprising the steps of:

obtaining historical information of passenger arrival rates at the predetermined floor;

determining, based on said historical information, a passenger arrival rate at the predetermined floor;

predicting, based on said predetermined passenger arrival rate, the number of people waiting behind the hall call at the predetermined floor; and determining said car load penalty based on said comparison and said predicted number of people.

4. The method of claim 3, wherein said car load penalty is substantially equal to zero if the car has a coincident car call stop at the predetermined floor.

5. A method of controlling the dispatching of elevator cars based on a system of bonuses and penalties, said penalties including a car load penalty for penalizing the stopping of a relatively loaded elevator car at a predetermined floor registering a hall call, said method comprising the steps of:

determining the load of the car when the car reaches the predetermined floor, $C_{ld}$;

comparing said determined load, $C_{ld}$, to a predetermined car load limit, $C_{ldl}$;

obtaining historical information of passenger arrival rates at the predetermined floor;

determining, based on said historical information, a passenger arrival rate at the predetermined floor;

predicting, based on said determined passenger arrival rate, the number of people waiting behind the hall call at the predetermined floor, $N_{phc}$; and determining said car load penalty based on said comparison and said predicted number of people based on the following equation:

$$a(C_{ld}-C_{ldl})-b(N_{phc})$$

wherein "a" and "b" represent predetermined constants.

6. The method of claim 5, wherein "a" is in the range of about 0.3 to about 3.0.

7. The method of claim 5, wherein "b" is in the range of about 0.5 to about 1.5.

8. The method of claim 5, wherein said car load penalty is substantially equal to zero if the car has a coincident car call stop at the predetermined floor.

9. The method of claim 5, wherein said car load penalty is substantially equal to zero if said determined load, $C_{ld}$, is less than said predetermined car load limit, $C_{ldl}$.

10. A method of controlling the dispatching of elevator cars based on a system of bonuses and penalties, said penalties including a hall call mismatch penalty for penalizing the stopping of an elevator car based on a comparison of the elevator's spare capacity with the number of people expected at a floor registering a hall call, said method comprising the steps of:

predicting car load at the floor registering the hall call should the car stop to pick-up and/or discharge passengers at all its currently scheduled stops;

predicting the number of people behind the hall call;

comparing said predicted number of people to a predetermined threshold;

determining the value of said hall call mismatch penalty based on said comparison.

11. The method of claim 10, wherein the step of determining the value of said hall call mismatch penalty based on said comparison, if said predicted number of people is less than said predetermined threshold, comprises the steps of:

assigning a relatively small number to said hall call mismatch penalty if said predicted car load is less than a predetermined car load limit; or assigning a relatively large number to said hall call mismatch penalty if said predicted car load is greater than or equal to a predetermined car load limit.

12. The method of claim 11, wherein said predetermined car load limit is about 80% of the maximum car load limit.

13. The method of claim 10, wherein the step of determining the value of said hall call mismatch penalty based on said comparison, if said predicted number of people is greater than or equal to said predetermined threshold, comprises the steps of:

comparing said predicted number of people to a first predetermined value; and determining the value of said hall call mismatch penalty based on said comparison.

14. The method of claim 13, wherein the step of comparing said predicted number of people to a first predetermined value, if said predicted number of people is less than or equal to said first predetermined value, comprises the steps of:

predicting spare capacity in the car, based on said predicted car load; and assigning a relatively large number to said hall call mismatch penalty if said predicted spare capacity is less than said predicted number of people; or assigning a relatively small number to said hall call mismatch penalty if said predicted spare capacity is greater than or equal to said predicted number of people.

15. The method of claim 13, wherein the step of comparing said predicted number of people to a first predetermined value, if said predicted number of people is greater than said first predetermined value, comprises the steps of:

predicting spare capacity in the car, based on said predicted car load;

comparing said predicted spare capacity to a second predetermined value; and determining the value of said hall call mismatch penalty based on said comparison.

16. The method of claim 15, wherein the step of determining the value of said hall call mismatch penalty based on said comparison, if said spare capacity is less than said second predetermined value, comprises the step of:

assigning a relatively large number to said hall call mismatch penalty.

17. The method of claim 15, wherein the step of determining the value of said hall call mismatch penalty based on said comparison, if said spare capacity is greater than or equal to said second predetermined value, comprises the step of:

assigning a relatively small number to said hall call mismatch penalty.

18. The method of claim 17, said method further comprising the step of:

generating a car request signal if said spare capacity is less than said predicted number of people.

19. The method of claim 18, said method further comprising the step of:

cancelling said generated car request signal if the car is not fully loaded after the car answers the hall call.

20. The method of claim 10, wherein the step of predicting car load comprises the steps of:

determining the floors where the car is scheduled to stop en route to said floor registering a hall call;

obtaining historical information of passenger boarding rates at the en route floors scheduled in response to a hall call;

determining, based on said historical boarding information, a passenger boarding rate at each of the en route floors scheduled in response to a hall call;

predicting, based on said predetermined passenger boarding rate, the number of people which will board the car at each of the en route floors scheduled in response to a hall call;

obtaining historical information of passenger deboarding rates at the en route floors scheduled in response to a car call;

determining, based on said historical deboarding information, a passenger deboarding rate at each of the en route floors scheduled in response to a car call;

predicting, based on said determined passenger deboarding rate, the number of people which will deboard the car at each of the en route floors scheduled in response to a car call;

determining the current car load; and predicting car load should the car stop at the floor, based on said current car load, said predicted number of boarding people and said predicted number of deboarding people.

* * * * *